United States Patent [19]

Newhard

[11] 3,989,550

[45] Nov. 2, 1976

[54] METHOD OF FORMING A HYDROPHILIC COATING ON AN ALUMINUM SURFACE

[75] Inventor: Nelson J. Newhard, Plymouth Meeting, Pa.

[73] Assignee: Amchem Products, Inc., Ambler, Pa.

[22] Filed: Apr. 21, 1975

[21] Appl. No.: 570,307

[52] U.S. Cl. ..... 148/6.16; 148/6.27; 156/22

[51] Int. Cl.[2] ..... C23F 7/14; C23F 7/26

[58] Field of Search ..... 148/6.16, 6.27, 6.2; 156/22

[56] References Cited

UNITED STATES PATENTS

| | | | |
|---|---|---|---|
| 2,438,877 | 3/1948 | Spruance, Jr. | 148/6.16 |
| 2,654,701 | 10/1953 | Calderon et al. | 156/22 X |
| 3,391,032 | 7/1968 | Hansen et al. | 148/6.16 |
| 3,493,441 | 2/1970 | Rausch et al. | 148/6.16 X |
| 3,592,747 | 7/1971 | Cohn | 148/6.27 X |
| 3,687,740 | 8/1972 | Pearlstein et al. | 148/6.27 X |
| 3,846,182 | 11/1974 | Huff et al. | 148/6.2 |

FOREIGN PATENTS OR APPLICATIONS

| | | | |
|---|---|---|---|
| 678,119 | 7/1939 | Germany | 148/6.16 |

*Primary Examiner*—Ralph S. Kendall

*Attorney, Agent, or Firm*—E. G. Szoke; M. E. Zall; R. S. Tong

[57] ABSTRACT

A method of forming a hydrophilic coating on an aluminum surface comprises the steps of:

a. etching the aluminum surface;

b. treating the etched aluminum surface with an acidic first aqueous solution comprising from about 0.5 to about 3 g/l of active fluoride, from about 2.5 to about 60 g/l of chromate ion (calculated as $CrO_3$) and from about 2 to about 300 g/l of phosphate ion, so as to form a coating having a weight of at least 150 mg/sq. ft.;

c. treating the aluminum surface with an alkaline second solution containing an alkali metal silicate; and d. baking the treated aluminum surface.

10 Claims, No Drawings

METHOD OF FORMING A HYDROPHILIC COATING ON AN ALUMINUM SURFACE

BACKGROUND OF THE INVENTION

This invention relates to a method of forming a hydrophilic coating on an aluminum surface. In particular, it is concerned with a method of forming a hydrophilic coating on an aluminum heat exchanger.

In a heat exchanger, such as that found in an air conditioning system of an automobile, heat is transferred from a heat transfer fluid within the heat exchanger to a fluid stream (in the case of an automobile, usually an air stream) passing over the external surface of the heat exchanger. The efficiency of the heat exchangers is increased by increasing the surface area over which the fluid stream passes, and for this reason they are normally constructed of a "honeycomb" pattern with a plurality of small passages through which the fluid stream may pass and so cool the heat transfer fluid within the heat exchanger. This type of construction does lead to problems, however, since the cooling of the fluid stream causes the moisture carried by that stream to condense within the passages, effectively blocking them. Indeed, frequently such condensation is cooled sufficiently for it to freeze and thus form a solid blockage within the passages.

Clearly, the blocking of passages within the heat exchanger reduces the surface area through which heat may be transferred and thus the efficiency of the heat exchanger suffers. In addition, the increased resistance to air flow caused by the blocked passage means that more power is required to force the fluid stream through the heat exchanger. Thus, in automobiles, more power is required from the blower motor which drives the air stream through the heat exchanger.

It has been found that by making the surface of the heat exchanger hydrophilic, water that condenses on the surface will run off and not cause plugging. It is highly desirable, therefore, to form a hydrophilic coating on the heat exchanger surface.

A number of methods of forming such a hydrophilic coating have been tried in the past. For example, U.S. Pat. No. 3,551,183 describes a method for forming a hydrophilic coating on the flash evaporation chamber of a steam iron. The hydrophilic coating is formed by depositing a solution containing a sodium silicate and hydrated alumina onto the surface and heating the surface to form a coating.

A method of forming a hydrophilic coating on aluminum surfaces and particularly on heat exchangers, is disclosed in U.S. Pat. No. 3,846,182. This patent describes a method in which the aluminum surface is coated by immersing it first in an aqueous solution containing an alkali metal chromate or dichromate, the chromium to carbonate ratio being maintained in the range from 0.05 to 0.5. The aluminum surface is then immersed in a second solution containing an alkali metal oxide and silicon dioxide in a ratio of from 1:1.5 to 2:1. However, this method suffers from a number of disadvantages. The process for forming the first coating by contacting the surface with an alkali metal carbonate and an alkali metal chromate or dichromate is essentially what is known as a Modified Bayer-Voegel process (MBV), and it gives a very high rate of etch of the surface being treated. This is, of course, undesirable, and particularly so for the treatment of aluminum heat exchangers which are frequently constructed of relatively thin gauge aluminum sheet. In addition, the MBV process involves the use of temperatures of 170° to 210° F, and the energy expended in maintaining this temperature is an important economic consideration.

It is an object of this invention to provide a method of forming a hydrophilic coating on an aluminum surface.

It is also an object to provide such a method which does not recessitate an undesirably high rate of etch of the aluminum surface.

A further object is to provide a method operating at lower temperatures, with consequent savings in energy.

SUMMARY OF THE INVENTION

Accordingly, this invention provides a method of forming a hydrophilic coating on an aluminum surface, which comprises the steps of:

a. etching the aluminum surface;

b. treating the etched aluminum surface with an acidic first aqueous solution consisting essentially of from about 0.5 to about 3 g/l active fluoride, from about 2.5 to about 60 g/l chromate ion (calculated as $CrO_3$) and from about 2 to about 300 g/l phosphate ion, so as to form a coating having a coating weight of at least 150 mg/sq. ft.;

c. treating the coated aluminum surface with an alkaline second aqueous solution consisting essentially of an alkali metal silicate, the molar ratio of alkali metal oxide to silicon dioxide being in the range of from about 1:4 to about 2:1; and d. baking the aluminum surface.

DETAILED DESCRIPTION OF THE INVENTION

It has been found that the best results for a hydrophilic coating are obtained when the treatment is applied to a roughened aluminum surface. Accordingly, the first step of the process of the invention involves the etching of the aluminum surface to provide this desirable rough surface. By choosing the etchants carefully, the amount of metal lost in the etching step may be controlled so that it does not occur at an undesirable rate. This is to be contrasted with the inevitable large degree of etching that occurs when an aluminum surface is treated according to the prior art process using MVB coating procedures; in that case the degree of etch cannot be controlled without affecting the formed coating.

The etching step also acts to clean the aluminum surface preparatory to the coating steps, and so ensure a clean, deoxidized surface.

The etchant used in the process of the invention may be any convenient etchant which is suitable for use with aluminum. While the etchant may be either acidic or alkaline, it is highly preferred to employ an alkaline etchant. Such alkaline etchants for aluminum are well known in the art. Preferred alkaline etchants include the alkali metal hydroxides, and the particularly preferred etchant is sodium hydroxide. In the present invention it is usually most convenient to employ the etchant in aqueous solution, and this solution may also contain conventional inhibitors and bath extenders, if desired.

A particularly preferred etchant for use in this invention is an aqueous solution containing from about 2 to about 20 g/l sodium hydroxide. By way of example, two etchant compositions which may be used with advantage in the method of the invention are:

| | |
|---|---|
| Etchant A | |
| sodium hydroxide | 2.95 g |
| gluconic acid | 0.088 g |
| water q.s. for 1 liter | |
| Etchant B | |
| sodium hydroxide | 14.76 g |
| gluconic acid | 0.44 g |
| water q.s. for 1 liter | |

Gluconic acids in the etchant solution acts as a sludge modifier, that is it softens the scale deposits on the surfaces of the treating tank walls and heating coils employed in the treatment tank.

The etchant may be applied to the aluminum surface to be treated in any convenient manner, but is preferred to immerse the aluminum surface in the etchant. The conditions of the etching step, and particularly the time of contact between the aluminum surface and the etchant, and the temperature of the etchant will depend upon a variety of factors including the nature of the etchant, the method of application and the condition of the aluminum surface. It may be said generally that the aluminum surface may be contacted with the etchant for as short a time as 5 seconds or for as long as 10 minutes, but typically the contact time will be from about 30 seconds to about 5 minutes, when the aluminum surface is immersed in the etchant.

The temperature of the etchant will normally lie in the range of from room temperature (about 68° F) to about 200° F, but is preferably in the range of from about 120° to 180° F.

It has been found that improved results may be obtained by the addition of alkali metal salts to the etchant. As is described hereinafter, it has been found possible in some instances to obtain a satisfactory hydrophilic coating with a smaller coating weight when one or more alkali metal salts are added to the etchant. Amongst the alkali metal salts that have given improved results are the nitrates, sulphides and halides, and the fluorides have shown themselves to be particularly effective. A particularly preferred alkali metal salt for use as an additive is sodium fluoride, since this has enabled satisfactory hydrophilic coating to be obtainable with markedly lower coating weights.

When an alkali metal salt is added to the etchant it is preferably present in an amount of from about 0.1 to about 5 g/l, and most preferably from about 0.1 to about 2 g/l.

Following the etching of the aluminum surface it is preferably rinsed in water to remove excess etchant and to prevent contamination of the subsequent treatment solutions.

The etched aluminum surface is then immersed in the first solution so as to form a coating of at least 150 mg/sq. ft. coating weight. The first solution contains chromate, phosphate and fluoride ions, and solutions of this type have been described in a number of publications.

U.S. Pat. No. 2,438,877 discloses coating aluminum using a solution containing 0.9 – 12.5 g/l fluorine, 3.75 – 60 g/l $CrO_3$ and 2 – 285 g/l $PO_4$, where the F: $CrO_3$ ratio is in the range of 0.135 – 0.405 and the pH is in the range of 1.6 to 2.2.

U.S. Pat. No. 2,494,910 discloses coating aluminum with solutions containing 1.5 – 300 g/l $PO_4$, 3.5 – 150 g/l $Cr_2O_7$ and 0.75 – 95 g/l fluorine, where the $Cr_2O_7$:F ratio is in the range of 1:0.375 to 1:5.45 and the pH is in the range of 3.2 to 7.0.

U.S. Pat. No. 2,928,763 discloses coating aluminum with solutions containing 5 – 159 g/l $PO_4$, 2.5 – 63 g/l $CrO_3$, 1 – 55 g/l aluminum ion and 2.5 – 123 g/l fluoride ion, the concentration of fluoride ion being directly proportional to the concentration of aluminum ion, and where the pH is in the range of 0.8 to 1.5. The ratio of F:$CrO_3$ of these solutions is in the range of about 0.5 to about 3.8.

Thus, it will be appreciated that under the appropriate conditions coating solutions containing chromate, phosphate and fluoride ions can operate with a wide range of ion contents, F:$CrO_3$ ratios and pHs.

In the method of this invention, the fluoride, phosphate and chromate ions may be introduced either as the corresponding acid — and thus as hydrofluoric acid, phosphoric acid and chromic acid — or as their salts. Suitable fluoride salts include the simple alkali metal fluorides, such as sodium fluoride, and the alkali metal acid fluorides. Complex fluorides could also be used, provided that they are capable of releasing sufficient active fluoride ion into the bath, but they are not usually practical sources of fluoride ion since large quantities have to be employed to yield the desired amount of active fluoride ion.

It should be pointed out that the fluoride content is specified in terms of active fluoride (that is, free and uncomplexed fluoride). This is because as the first solution is used it is inevitable that some aluminum will go into solution. Aluminum, and indeed various other metals such as calcium, form complexes with fluoride ion and when this happens the active fluoride content of the first solution is reduced, although of course the total amount of fluorine therein remains the same. Fluoride present in the first solution in complexed form is not available to assist in the formation of a coating and thus it is important to maintain the active fluoride ion content within the limits of the invention. This may, of course, be achieved by the addition of hydrofluoric acid or any fluoride as described above for the original make-up of the bath.

The total fluoride content (active and complexed) will be increased by the addition of further fluoride ion, and be considerably greater than the upper limit specified for active fluoride. By way of illustration, the total fluoride content of the first solution may be as high as 150 g/l.

References herein to "active fluoride" means free and uncomplexed fluoride, where as references to "total fluoride" mean the total amount of fluoride present in whatever form.

The active fluoride content of the first solution may be determined and monitored by means of a fluoride specific electrode, and such devices are well known in the art. A method of determining active fluoride concentration is described, for example, in U.S. Pat. No. 3,350,284.

Suitable chromate salts which may be employed in the method of the invention include the alkali metal chromates and dichromates — for example, sodium chromate and potassium dichromate.

Suitable phosphate salts for use in the method of the invention include the mono-(alkali metal) salts — for example, mono-sodium phosphate, and monoammonium phosphate.

It is highly preferred that the fluoride, chromate and phosphate ions be introduced in the form of their corresponding acids — that is to say, fluoride as hydrofluoric acid, chromate as chromic acid and phosphate as phosphoric acid.

The ranges of ion content specified hereinbefore for the first solution represent the ranges found to produce particularly effective coatings. Operating outside these ranges may result in no coating being formed or in an unsatisfactory coating (for example, a powdery of non-adherent coating) being formed. It has further been found that optimum coatings may be obtained by treatment with a first solution make up and operated within narrower, preferred concentration ranges.

The preferred range of active fluoride content is from about 0.5 to about 12.5 g/l, and most preferably from about 1.0 to about 6.0 g/l.

The preferred range of chromate content is from about 3.0 to about 40 g/l, and most preferably from about 6.0 to about 20 g/l.

The preferred phosphate ion content is from about 6 to about 285 g/l, and most preferably from about 20 to about 100 g/l.

As will be appreciated from the prior art, the pH of a coating solution of the type used for the acidic first solution in the method of this invention may vary over quite a wide range. However, it is preferred to operate within the range of about 0.8 to about 2.5, and most preferably within the narrower range of about 0.8 to about 1.5.

The etched aluminum surface may be contacted with the first solution in any convenient manner, but it is preferred to immerse the etched aluminum surface in the first solution. The contact time must be sufficient to form a coating of the desired thickness, and depending upon the concentration of the constituents of the first solution this contact time may vary over quite a wide range. It is believed to be within the competence of one skilled in the art to determine the optimum contact time for a given first solution and the coating thickness desired, but by way of general indication it may be said that the contact time will usually lie within the range of from about 30 seconds to 10 minutes, although in certain circumstances times outside this range might be satisfactory.

The rate of coating formation is to some extent temperature dependent — high temperatures tend to give more rapid coating formation. Accordingly the contact time and the temperature of the first solution are related. Again it is believed to be within the competence of one skilled in the art to select a suitable temperature, but by way of illustration the temperature will normally be in the range of from room temperature to about 180° F. A great advantage of the method of the present invention is that a coating of the desired weight may be produced in a reasonable time at relatively low temperatures — typically from about 80 to about 120° F. A particularly preferred temperature for the first solution is in the region of 100° F, this temperature representing the optimum compromise between speed of coating formation and the energy used to maintain the temperature.

The coating produced by the treatment of the etched aluminum surface with the first solution should have a coating weight of at least 150 mg/sq. ft., since it has been found that a lower coating weight does not result in a sufficiently hydrophilic coating following treatment with the second solution and baking. Generally the greater the coating weight produced by treatment with the first solution the more hydrophilic is the aluminum surface following treatment. However, a very heavy coating weight inevitably means the rapid consumption of energy and materials in the formation of such a coating. Consequently, the coating weight produced by treatment in the first solution, is preferably in the range of about 200 to about 600 mg/sq. ft.

As mentioned hereinbefore, the addition of alkali metal salts to the etchant may enable the coating weight to be substantially reduced while maintaining the hydrophilic nature of the treated aluminum surface. The reduction in the coating weight required to produce the desired hydrophilic surface by the addition of alkali metal salts to the etchant is a most surprising and unexpected effect which may lead to a considerable saving in materials without any sacrifice of performance. By way of illustration, it has been found that by incorporating sodium fluoride into a sodium hydroxide etchant solution the coating weight could be reduced by 50 percent without there being any decrease in the hydrophilic properties of the aluminum surface following the silicate rinse and baking.

By way of example only, the following formulations are given as illustrative of formulations which may be employed as the first solution.

| | |
|---|---|
| Formulation A | |
| Chromic acid | 10.0 g |
| Hydrofluoric acid | 2.1 g |
| 75% Phosphoric acid | 45 ml |
| Water q.s. for 1 liter | |
| Formulation B | |
| Chromic acid | 10.0 g |
| Hydrofluoric acid | 1.22 g |
| 75% Phosphoric acid | 45 ml |
| Water q.s. for 1 liter | |

Following treatment of the etched aluminum surface with the first solution, the aluminum surface is preferably rinsed in water before further treatment.

After treatment with the first solution the aluminum surface is treated with the second solution which contains an alkali metal silicate. It is possible to have a range of different silicates in solution depending upon the relative amounts of alkali metal oxide and silicon dioxide that are present in the solution. The molar ratio of alkali metal oxide to silicon dioxide in the second solution used in the invention should be in the range of from about 1.4 to about 2.1. However, optimum results are obtained by employing solutions in which the molar ratio of alkali metal oxide to silicon dioxide is from about 1:2 to about 1:1, and most preferably in the narrower range of from about 1:2 to 1:1.5. The solutions falling within these narrower ranges are preferred because they give excellent hydrophilic surfaces without undesirable etch or undermining of the coating formed by treatment with the first solution.

The alkali metal oxide component of the silicate is preferably sodium or potassium oxide. There are a variety of commercial sources of alkali metal silicate — for example:

Liquid N* (containing sodium silicates; $Na_2O:SiO_2 = 0.3:1$);

Liquid D* (containing sodium silicates; $Na_2O:SiO_2 = 0.49:1$);

Metso Granular* (containing sodium metasilicate; $Na_2O:SiO_2 = 1:1$);

Kasil No. 1* (containing potassium silicate; $K_2O:SiO_2 = 0.25:1$); and

Kasil No. 6* (containing potassium silicates; $K_2O$:-$SiO_2$ = 0.3:1).

*[These are commercial compositions, available from Philadelphia Quartz Company of Pennsylvania, U.S.A.]

The molar ratio of alkali metal oxide to silicon dioxide in a silicate-containing solution may be increased if desired by the addition of the appropriate amount of alkali metal hydroxide to the silicate-containing solution.

The second solution preferably contains from about 0.05 to about 2 percent by weight of silicon dioxide, and most preferably from about 0.075 to about 1 percent by weight of silicon dioxide.

By way of illustration, the following formulations are examples of second solutions for use in the invention:

| | |
|---|---|
| Formulation D | |
| Kasil No. 6 [12.50% $K_2O$; 26.3% $SiO_2$] | 29.1 g. |
| Potassium hydroxide | 3.09 g. |
| Tetrapotassium pyrophosphate | 8.03 g. |
| Water q.s. for 1 liter. | |
| $K_2O$:$SiO_2$ molar ratio = 1:1.9 | |
| Formulation E | |
| Kasil No. 6 | 4.87 g. |
| Potassium hydroxide | 0.51 g. |
| Tetrapotassium pyrophosphate | 1.34 g. |
| Water q.s. for 1 liter | |
| $K_2O$:$SiO_2$ molar ratio = 1:1.9 | |
| Formulation F | |
| 1.6% aqueous solution of Liquid N [8.90% $Na_2O$; 28.7% $SiO_2$] | |
| $Na_2O$:$SiO_2$ molar ratio - 1:3.3 | |
| Formulation G | |
| 1.4% aqueous solution of Liquid D [14.70% $Na_2O$; 29.4% $SiO_2$] | |
| $Na_2O$:$SiO_2$ molar ratio = 1:2.1 | |
| Formulation H | |
| Kasil No. 6 | 24.3 g. |
| Potassium hydroxide | 16.5 g. |
| Tetrapotassium pyrophosphate | 6.89 g. |
| Water q.s. for 1 liter | |
| $K_2O$:$SiO_2$ molar ratio = 1:0.6 | |
| Formulation I | |
| Kasil NO. 6 | 4.05 g. |
| Potassium hydroxide | 2.74 g. |
| Tetrapotassium pyrophosphate | 1.15 g. |
| Water q.s. for 1 liter | |
| $K_2O$:$SiO_2$ molar ratio = 1:0.6 | |

The aluminum surface may be treated with the second solution in any convenient manner, but most conveniently the aluminum surface is immersed in the second solution. The time of immersion may be from about 10 seconds to about 20 minutes, but it is preferred to use an immersion time of from about 30 seconds to about 6 minutes since this has been found to give excellent hydrophilic surfaces while minimizing the treatment time.

The time of treatment with the second solution is also related to the temperature of the second solution. It is usually preferred to operate with the second solution at a temperature of from about 100° F to boiling temperature, and most preferably within the narrower range of about 100° to about 200° F. In a particularly preferred embodiment of the invention the aluminum surface is immersed in the second solution at a temperature of from about 100° to about 200° F fro from about 1 to about 5 minutes.

Following treatment with the second solution, and preferably without further treatment, the aluminum surface is baked to consolidate the hydrophilic coating. The temperature and time for this baking step would normally be chosen empirically by determining the conditions which give a satisfactory consolidated coating with the most economical use of energy. However, by way of illustration, it may be said that the baking temperature will normally be in the range of from about 250° to about 500° F, and more usually from about 300° to about 400° F. The baking time will usually lie in a range of from about 1 to about 20 minutes, and preferably from about 5 to about 10 minutes.

The aluminum surface when treated according to the method of this invention acquires an excellent hydrophilic surface, and it is obtained with the expenditure of less energy (lower temperatures and shorter treatment times) than the prior art processes. In addition there is less etching of the aluminum surface during the formation of the hydrophilic coating which is of particular importance when treating thin aluminum sheets or intricate aluminum articles, such as heat exchanges. Accordingly, this invention has been found to be particularly effective at forming hydrophilic coatings on aluminum heat exchangers.

The following Examples are now given, though only by way of illustration, to show preferred method, techniques and quantities that may be employed in the method of this invention.

SPREADING DROP TEST

In order to assess the hydrophilic nature of surfaces treated according to this invention and according to the prior art procedures, it was necessary to have a test which quantifies the hydrophilic nature of the surface, and this was provided by the Spreading Drop Test. In this test, a drop of water is placed on the surface and allowed to spread, the extent of the water spread being measured and used as a measure of the hydrophilic nature of the surface. This test has proved reliable, repeatable and a good indication of the performance of aluminum heat exchangers in shedding condensation.

In order to make the test repeatable a standard procedure is employed, as follows:

The surface to be tested is exposed to conditions of constant humidity in a Cleveland Condensing Humidity Cabinet for 140 hours at 100° F. They are then removed and immediately rinsed with deionized water, dried in air and allowed to stabilize at room temperature for one hour. Three drops of deionized water (5 microliters each) are then carefully placed, on the top, middle and bottom of each surface to be tested, using a calibrated microsyringe. The spread in millimeters is measured for each drop after it has reached its maximum coverage.

It has been found that a spread of 15 mm or greater indicates a satisfactory level of hydrophilicity for aluminum heat exchangers.

EXAMPLE 1

Two aluminum panels of alloy 3003 were provided with a hydrophilic coating by treating them according to the method of this invention. The panels were subjected to the following steps:

| STEP | BATH | TEMP. | TIME |
|---|---|---|---|
| Etch | 2.95 g/l sodium hydroxide<br>0.088 g/l gluconic acid | 150–160° F | 90 secs. |

-continued

| | | | |
|---|---|---|---|
| RINSE | WATER | | |
| First solution | 2.1 g/l hydrofluoric acid<br>10 g/l chromic acid<br>45 ml/l 75% phosphoric acid<br>Coating weight approx. 550 mg/sq. ft. | 100° F | 279 secs. |
| RINSE | WATER | | |
| Second solution | 29.2 g/l Kasil No. 6 [12.50% $K_2O$; 26.3% $SiO_2$]<br>3.09 g/l potassium hydroxide<br>8.03 g/l tetrapotassium pyrophosphate<br>$K_2O:SiO_2$ molar ratio = 1:1.9 | 150° F | 279 secs. |
| BAKE | | 375° F | 10 mins. |

COMPARISON

To provide a comparison, a second pair of aluminum panels were treated with the same sequence of steps, except that the immersion in the second solution was omitted.

RESULTS

The two sets of panels were then subjected to the Speading Drop Test and the results, expressed as the diameter (in mm) of the spread drop, are set out in the table below.

Table 1

Spreading Drop Test

| Comparison | | | Invention | | |
|---|---|---|---|---|---|
| Top | Middle | Bottom | Top | Middle | Bottom |
| 6 | 4 | 5 | 36 | 28 | 38 |
| 7 | 6 | 4 | 28 | 31 | 30 |
| Average 5.3 | | | | 31.8 | |

It is clear that the method of the invention gives a markedly superior hydrophilic coating as compared to a process in which the immersion in the silicate is omitted. The large value obtained in the Spreading Drop Test for the panels treated according to the invention shows that this would be an excellent treatment for aluminum heat exchangers to overcome the problem of condensed liquid accumulating on the heat exchanger surface.

EXAMPLE 2 - ADDITION OF SODIUM FLUORIDE TO THE ETCHANT.

TREATMENT A

A set of panels were treated according to the method of the invention, with the addition of sodium fluoride to the etchant. The details of the treatment are as follows:

| STEP | BATH | TEMP. | Time |
|---|---|---|---|
| Etch | 3.69 g/l sodium hydroxide<br>0.11 g/l gluconic acid<br>0.6 g/l sodium fluoride | 160° F | 87 secs. |
| RINSE | WATER | | |
| First solution | 1.58 g/l hydrofluoric acid<br>10 g/l chromic acid<br>45 ml/l 75% phosphoric acid<br>Coating weight approximately 275 mg/sq. ft. | 100° F | 279 secs. |
| RINSE | WATER | | |
| Second | As Example 1 | 150° F | 5 mins. |

-continued

| | | |
|---|---|---|
| BAKE | 350° F | 5 mins. |

TREATMENT B

A second set of panels was treated according to the method of the invention, but with no alkali metal salt additive in the etchant and using a higher coating weight than employed in Treatment A. The details of the treatment are set out below:

| STEP | BATH | TEMP. | TIME |
|---|---|---|---|
| Etch | As Example 1 | 160° F | 90 secs. |
| RINSE | WATER | | |
| First solution | As Example 1 | 100° F | 279 secs. |
| RINSE | WATER | | |
| Second solution | As Example 1 | 150° F | 5 mins. |
| BAKE | | 350° F | 5 mins. |

RESULTS

The panels were then tested using the Spreading Drop Test, and the results are as set out below:

Table 2

Spreading Drop Test

| | Diameter(mm) Spread Drop | | | |
|---|---|---|---|---|
| Treatment | Top | Middle | Bottom | Average |
| A | 29 | 30 | 22 | 27 |
| B | 18 | 25 | 25 | 23 |

It may be seen that by incorporating sodium fluoride into the etchant in Treatment A a greater degree of hydrophilicity was obtained than with Treatment B, even though the coating produced by immersion in the first solution was only half the weight of that produced in Treatment B. Clearly, the inclusion of sodium fluoride in the etchant gives a substantial saving in energy and materials without any loss in performance.

EXAMPLE 3 - EFFECT OF THE ADDITION OF VARIOUS ALKALI METAL SALTS TO THE ETCHANT.

Aluminum panels were treated according to the method of the invention in order to ascertain the effect of adding alkali metal salts to the etchant. The details of the treatments used are as follows:

| STEP | BATH | TEMP. | TIME |
|---|---|---|---|
| Etch | Panel a) As Example 1<br>Panel b) As Example 1 + 0.06 | | |

-continued

| | | | |
|---|---|---|---|
| | g/l sodium fluoride<br>Panel c) As Example 1 + 0.1 g/l sodium sulphide | 160° F | 90 secs. |
| RINSE | WATER | | |
| First Solution | As Example 1<br>Coating weight approx. 550 mg/sq.ft. | 100° F | 2½ mins. |
| RINSE | WATER | | |
| Second solution | 24.3 g/l Kasil No. 6<br>16.5 g/l potassium hydroxide<br>6.8 g/l tetrapotassium phosphate<br>$K_2O:SiO_2$ molar ratio approx. 1.7:1 | 200° F | 5 mins. |
| BAKE | | 212° F | [?] |

RESULTS

The treated panels were then subjected to the Spreading Drop Test and the results are shown in the table which follows:

Table 3

| Spreading Drop Test | | | | |
|---|---|---|---|---|
| | Spread Drop Diameter (mm) | | | |
| Panel | Top | Middle | Bottom | Average |
| a | 19 | 18 | 18 | 18.3 |
| b | 22 | 25 | 25 | 24 |
| c | 19 | 20 | 22 | 20.3 |

It may be seen that the addition of the alkali metal salts to the etchant gives a substantial increase in hydrophilicity as compared to the treatment without such addition. Panel a has a good hydrophilicity, but panels b and c have even better hydrophilicity. In particular, panel b shows that the addition of as little as 0.06 g/l of sodium fluoride gives a substantial increase in the performance of the treated panel.

EXAMPLE 4 - EFFECT OF TEMPERATURE OF THE SECOND SOLUTION.

Aluminum panels of 3003 alloy were treated according to the method of this invention, with various temperatures being employed for the second solution. The details of the treatments are as follows:

| STEP | BATH | | TEMP. | TIME |
|---|---|---|---|---|
| Etch | As Example 1 + 0.06 g/l sodium fluoride | | 160° F | 90 secs. |
| RINSE | WATER | | | |
| First solution | As Example 1 | | 100° F | 280 secs. |
| RINSE | WATER | | | |
| Second solution | As Example 1 | Panel a) | 150° F | 280 secs. |
| | | Panel b) | 200° F | 280 secs. |
| BAKE | | | 350° F | 10 mins. |

RESULTS

The panels were subjected to the Spreading Drop Test and the results are shown in the table below. Two panels were subjected to each treatment and the results for both panels are shown.

Table 4

| Spreading Drop Test | | | | |
|---|---|---|---|---|
| | Spread Drop Diameter (mm) | | | |
| Panel | Top | Middle | Bottom | Average |
| a | 22,24 | 25,24 | 25,27 | 24.5 |
| b | 24,25 | 22,22 | 19,19 | 21.8 |

EXAMPLE 5 - EFFECT OF ALKALI METAL OXIDE

Aluminum panels of 3003 alloy were treated as follows:

| STEP | BATH | TEMP. | TIME |
|---|---|---|---|
| Etch | As Example 1 | 160° F | 90 secs. |
| RINSE | WATER | | |
| First solution | As Example 1 | 100° F | 280 secs. |
| RINSE | WATER | | |
| Second solution | Panel a) As Example 3 | 200° F | 280 secs. |
| | Panel b) As Example 1 | 200° F | 280 secs. |
| BAKE | | 350° F | 10 mins. |

RESULTS

The treated panels were then subjected to the Spreading Drop Test, and the results are given in the table on the following page. Two panels were treated by each of the second solutions tested, and the results for each panel are given in the table.

Table 5

| Spreading Drop Test | | | | |
|---|---|---|---|---|
| | Spread Drop Diameter (mm) | | | |
| Panel | Top | Middle | Bottom | Average |
| a | 20,22 | 21,25 | 24,29 | 23.5 |
| b | 21,23 | 24,23 | 22,25 | 23.0 |

The hydrophilicity of the two sets of treated panels are very similar. However, the second solution used to treat panel b is preferred since it is less alkaline and therefore gives less etch of the coating. It is desirable to reduce the etch of the underlying coating as much as possible to prevent dissolution of the coating and underlying surface which will interfere with the operation of the second solution and also affect the subsequent performance of the coating.

EXAMPLE 6 - EFFECT OF ALKALINE METAL OXIDE TO SILICON DIOXIDE RATIO IN THE SECOND SOLUTION

| STEP | BATH | TEMP. | TIME |
|---|---|---|---|
| Etch | 2.88 g/l sodium hydroxide .12 g/l sodium gluconate | 160° F | 90 secs. |
| RINSE | WATER | | |
| First solution | As Example 1 | 100° F | 5 mins. |
| RINSE | WATER | | |
| Second solution | See below | See below | See below |
| BAKE | | 212° F | 5 mins. |

A number of tests were carried out using various second solutions at a number of temperatures and times. The details of the tests are as follows:

| Test | SECOND SOLUTION | | | Alkali metal oxide silicon dioxide (molar ratio) | pH | Temperature (° F) | Time (mins.) |
|---|---|---|---|---|---|---|---|
| A | 24.3<br>16.5<br>6.89 | g/l<br>g/l<br>g/l | Kasil No. 6<br>potassium hydroxide<br>tetrapotassium pyrophosphate | 1.7:1 | 12.8 | 100 | 5 |
| B | 24.3<br>16.5<br>6.89 | g/l<br>g/l<br>g/l | Kasil No. 6<br>potassium hydroxide<br>tetrapotassium pyrophosphate | 1.7:1 | 12.8 | 150 | 5 |
| C | 24.3<br>16.5<br>6.89 | g/l<br>g/l<br>g/l | Kasil No. 6<br>potassium hydroxide<br>tetrapotassium pyrophosphate | 1.7:1 | 12.8 | 200 | 5 |
| D | 24.3<br>16.5<br>6.89 | g/l<br>g/l<br>g/l | Kasil No. 6<br>potassium hydroxide<br>tetrapotassium pyrophosphate | 1.7:1 | 12.8 | 200 | 1 |
| E | 24.3<br>16.5<br>6.89 | g/l<br>g/l<br>g/l | Kasil NO. 6<br>potassium hydroxide<br>tetrapotassium pyrophosphate + phosphoric acid to adjust pH | 1.7:1 | 11.8 | 200 | 5 |
| F | 24.3<br>16.5<br>6.89 | g/l<br>g/l<br>g/l | Kasil No. 6<br>potassium hydroxide<br>tetrapotassium pyrophosphate + phosphoric acid to adjust pH | 1.7:1 | 10.9 | 200 | 5 |
| G | | 1.6% | Liquid N | 1:3.3 | 10.75 | 200 | 6 |
| H | | 1.4% | Liquid D | 1:2.06 | 11.45 | 200 | 5 |
| I | | 2–4.4% | Kasil No. 1* | 1:3.93 | 10.6 | 200 | 5 |

*Kasil NO. 1 is a commercially available potassium silicate containing 8.30% $K_2O$ and 20.8% $SiO_2$ which may be obtained from the Philadelphia Quartz Company.

In tests E and F sufficient phosphoric acid was introduced into the second solution to adjust the pH to the value indicated to the table.

The second solutions tested all contained 6.4 g/l silicon dioxide.

RESULTS

The treated panels were subjected to the Spreading Drop Test and the results are given in the table below.

Table 6

| Spreading Drop Test | | | | |
|---|---|---|---|---|
| | Spread Drop Diameter (mm) | | | |
| Test | Top | Middle | Bottom | Average |
| A | 34 | 32 | 33 | 33 |
| B | 28 | 28 | 28 | 28 |
| C | 26 | 32 | 25 | 27.7 |
| D | 24 | 28 | 25 | 25.7 |
| E | 26 | 26 | 24 | 25.3 |
| F | 28 | 28 | 25 | 27 |
| G | 23 | 21 | 21 | 21.7 |

Table 6-continued

| Spreading Drop Test | | | | |
|---|---|---|---|---|
| | Spread Drop Diameter (mm) | | | |
| Test | Top | Middle | Bottom | Average |
| H | 20 | 19 | 23 | 20.3 |
| I | 20 | 24 | 26 | 23.3 |

The tests show that excellent results are obtained from a variety of silicate-containing solutions and a variety of treatment conditions. As indicated before it is desirable to use second solutions having a lower alkalinity since this gives less undesirable etch of the underlying coating.

EXAMPLE 7 - EFFECT OF BAKING TEMPERATURE

Aluminum panels of 3003 alloys were subjected to the following treatment according to the method of the invention:

| STEP | BATH | TEMP. | TIME |
|---|---|---|---|
| Etch | As Example 1 | 160° F | 90 secs. |
| RINSE | WATER | | |
| First solution | As Example 1 | 100° F | 280 secs. |
| RINSE | WATER | | |
| Second solution | As Example 3 | 200° F | 280 secs. |

The panels were dried or baked at various temperatures and for various lengths of time, and then subjected to the Spreading Drop Test. Two panels were given each different baking step and the results are given in the table below:

Table 7

| Spreading Drop Test | | | | | |
|---|---|---|---|---|---|
| Baking Step | | Spread Drop Diameter (mm) | | | |
| Temperature (° F) | Time (mins.) | Top | Middle | Bottom | Average |
| room temp. (68° F) | — | 20,22 | 19,22 | 20,22 | 20.8 |
| 212 | 1½ | 20,21 | 17,20 | 24,20 | 20.3 |
| 212 | 5 | 15,17 | 17,16 | 22,20 | 17.8 |
| 350 | 1½ | 28,27 | 29,27 | 26,26 | 27.2 |
| 350 | 5 | 25,29 | 25,29 | 28,29 | 27.5 |

The results show that particularly good results are obtained by baking at 350° F, although acceptable results are obtained at lower temperatures.

I claim:

1. A method of forming a hydrophilic coating on an aluminum surface comprising the steps of:

a. etching the aluminum surface with an aqueous etching solution to provide a rough surface;

b. treating the etched surface with an acidic first aqueous solution consisting essentially of active fluoride, chromate ion and phosphate ion to form a coating having a coating weight of at least 150 mg/sq.ft.;

c. treating the coated surface with an alkaline second aqueous solution consisting essentially of an alkali metal silicate, the molar ratio of alkali metal oxide to silicon dioxide in said alkaline solution in the range of from about 1:4 to about 2:1, the solution containing at least about .05 percent by weight of silicon dioxide; and immediately thereafter d. baking the surface.

2. The method of claim 1 wherein the acidic first solution consists essentially of from about 0.5 to about 3 grams per liter of active fluoride, from about 2.5 to about 60 grams per liter of chromate ion (calculated as $CO_3$) and from about 2 to about 300 grams per liter of phosphate ion.

3. The method of claim 1 wherein said etching solution comprises an alkali metal hydroxide.

4. The method of claim 3 wherein the alkali metal hydroxide is sodium hydroxide present in an amount from about 2 to about 20 grams per liter.

5. The method of claim 4 wherein there is added to the etching solution an alkali metal salt selected from the group consisting of alkali metal nitrate, alkali metal sulfide, and alkali metal halide.

6. The method of claim 5 wherein the alkali metal salt is present in an amount of from about 0.01 to about 5 grams per liter.

7. The method of claim 6 wherein the alkali metal salt is sodium fluoride present in an amount of from about 0.1 to about 2 grams per liter.

8. The method of claim 1 wherein the molar ratio of alkali metal oxide to silicon dioxide in the alkaline solution is from about 1:2 to about 1:1.

9. The method of claim 8 wherein the alkaline solution contains from about 0.05 to about 2 percent by weight of silicon dioxide.

10. The method of claim 1 wherein the alkaline solution is maintained at a temperature of from about 100° F to about 200° F and wherein the aluminum surface is immersed in said alkaline solution for a period of from about 1 minute to about 5 minutes.

* * * * *